US005292120A

United States Patent [19]

Pehoski et al.

[11] Patent Number: 5,292,120

[45] Date of Patent: Mar. 8, 1994

[54] GOLF TOOL

[76] Inventors: Richard J. Pehoski, 133 Maplewood Dr., Bolingbrook, Ill. 60440; Joseph A. Pessetti, 2910 N. Maple, Franklin Park, Ill. 60131

[21] Appl. No.: 976,482

[22] Filed: Nov. 16, 1992

[51] Int. Cl.[5] ..... A63B 57/00

[52] U.S. Cl. ..... 273/32 B; 15/105; 15/236.1; 172/380; 248/156

[58] Field of Search ..... 273/32 B, 32 H, 32 R; 7/170, 114; 172/378, 379, 380; 248/156; 15/236.01, 236.1, 105

[56] References Cited

U.S. PATENT DOCUMENTS 4,063,731 12/1977 Kitay ..... 273/32 B 4,670,932 6/1987 Williams ..... 273/32 B

*Primary Examiner*—George J. Marlo

*Attorney, Agent, or Firm*—Leo J. Aubel

[57] ABSTRACT

A tool for golf equipment which combines various function and features such as an oval ring for cleaning golf shoe cleats, a golf cleat tightner, a divot repair device, and a golf club shaft rest in a single unit.

1 Claim, 1 Drawing Sheet

GOLF TOOL

BACKGROUND OF THE INVENTION

The game of golf has become extremely popular. The golfing equipment per se and the accessories for such equipment have created a multi-billion dollar industry. There are a number of accessory items used with golfing equipment. Such accessories include devices for cleaning the cleats of golf shoes. Other devices are provided for tightening the cleats of golf shoes. Other types of accessories are provided for repairing divots on the putting greens. Still other types of accessories include devices useful as pads to rest golf clubs such as on the green to prevent the grip of the golf club from becoming wet when the club is laid down.

SUMMARY OF INVENTION

The present invention is a golf accessory comprising a unitary tool for tightening golf shoe cleats, fixing divots, cleaning golf shoe cleats, and for providing a golf club head rest; thus, the inventive tool provides multiple features and functions.

The foregoing features and advantages of the present invention will be apparent from the following more particular description of the invention. The accompanying drawings listed hereinbelow, are useful in explaining the invention.

DRAWINGS

DESCRIPTION OF THE INVENTION

Figure 1:
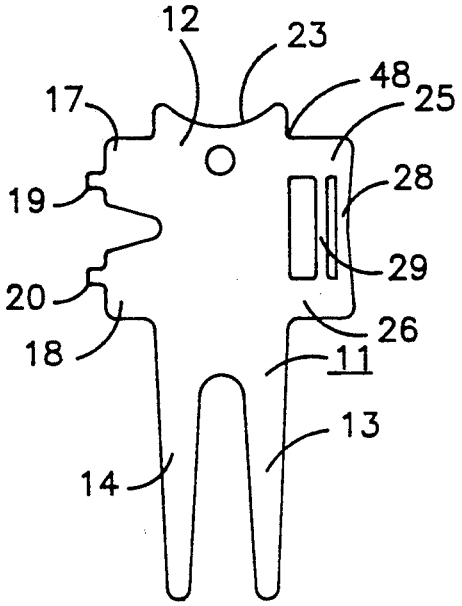
FIG. 1 is a frontal view of the inventive tool.

Refer first to FIG. 1 which shows a frontal view of one embodiment of the inventive tool 11 which includes a body section 12 having downwardly extending legs 13 and 14. In one embodiment the legs 13 and 14 are about 1.25 inches long and the overall length of the tool is 2.75 inches.

In the embodiment shown the tool 11 is stamped out of sixteen gauge cold rolled steel which is heated treated, deburred and polished. The tool 11 is then plated with copper, nickel and chrome or other suitable quality finishes to provide a high quality product which is durable, shiny and easy to clean. It has been found that a brass or aluminum body would distort and is not rigid enough to function as a shoe cleat tightening tool as will be described hereinbelow.

A first pair of spaced shoulders 17 and 18 extend outwardly from body 12. The shoulders 17 and 18 each have a protrusion 19 and 20 formed on their respective free ends. The protrusions 19 and 20 are spaced approximately 0.5 inches apart from each other to conform to the standard holes in the cleats for golf shoes. The protrusions 19 and 20 are insertable into the holes in the base of the cleat to engage the cleat to tighten or loosen the cleat.

In the embodiment shown, the legs 13 and 14 are spaced apart about 0.25 inches at their joining end and about 0.375 inches at their open ends. The legs are tapered slightly to narrow at their free ends. A user holds the body 12 of tool 11 and inserts the legs 13 and 14 into the sod to disturb, move and rearrange the sod to enable repair of a divot. The tapered shape of the legs 13 and 14 enables easy insertion and withdrawal of the legs from the sod.

The upper end of body 12 is slightly curved inwardly or recessed to form a cradle 23 for a grip on the shaft of a golf club. In one use of the tool 11, the legs 13 and 14 are inserted into the ground in a standing or upright position such that a golf club can be laid down on the ground and the grip on the shaft of the club can be rested on the cradle 23 which forms a retaining support for the shaft and grip. This protects the grip from moisture and dirt.

Figure 2:
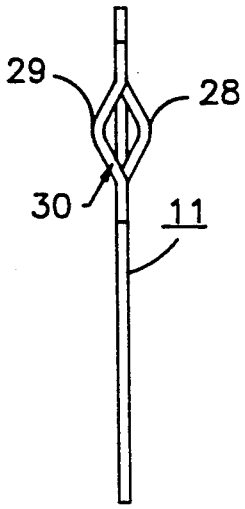
FIG. 2 is a side view of the tool of FIG. 1.
Figure 3:
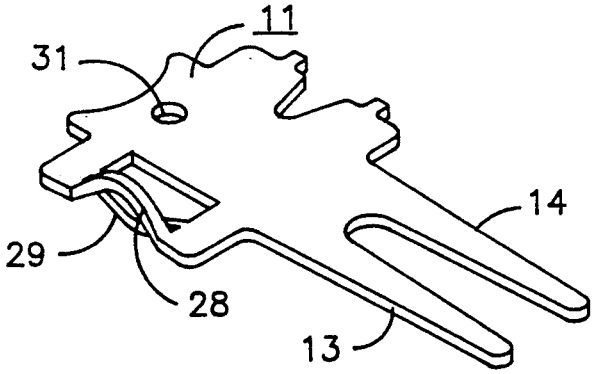
FIG. 3 is and isometric view of the inventive tool shown in a flat or horizontal position.
Figure 4:
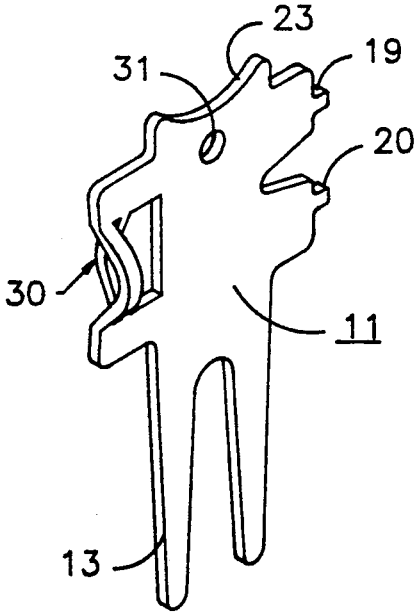
FIG. 4 is an isometric view of the inventive tool shown in an upright position.

Two spaced arms 25 and 26 extend outwardly from the opposite side of body 12. The arms 25 and 26 are about 0.25 inches wide and extend outwardly about 0.375 inches. the arms are spaced apart about 0.75 inches. As more clearly shown in FIG. 2 a pair of rails 28 and 29 extend between the spaced arms 25 and 26. The rails 28 and 29 are about 0.03 inches wide and are formed parallel and adjacent to each other with about 0.03 inches spacing therebetween. One rail 28 is bent outwardly in a first direction substantially perpendicular to the plane of body 12; and, the other rail 29 is bent outwardly in a opposite perpendicular direction to the plane of body 12. The rails 28 and 29 thus form an oval shaped ring 30. In one embodiment the oval ring is about 0.5 inches in the major direction and about 0.25 inches in the minor or narrow direction.

The ring 30 of rails 28 and 29 provides a means for cleaning the cleats of golf shoes. In use, the ring 30 is pushed onto and around the golf shoe cleat to engage and dislodge any material on the cleat.

Note that the various corners of the tool 11 are smoothed, beveled and rounded as at 48 to prevent the user from being cut or scratched, and also for better appearance of the tool.

A hole 31 is formed adjacent the top end of the body 12. Hole 31 is provided to accommodate a peg to hang the tool 11 or to accommodate a key chain such that the tool can function as a chain fob.

While the invention has been particularly shown and described with reference to a preferred embodiment thereof, it will be understood by those skilled in the art, that various changes inform and detail can be made therein without departing from the spirit and scope of the invention.

We claim:

1. A unitary tool for golf equipment comprising in combination, an elongated flat body section, a pair of tapered legs extending downwardly from said body section, said legs providing a means of disturbing and removing sod to enable repair of a divot, a pair of spaced shoulders extending outwardly from one side of said body section in a direction substantially perpendicularly to said legs, protrusions on the ends of said shoulders formed to accommodate holes in the base of golf cleats, a pair of spaced arms extending outwardly from the opposite side of said body section, a pair of rails extending between said spaced arms, said rails being curved in relatively opposite directions to form an oval ring thereby, each rail forming substantially one half of said oval ring, an opening in said arm adjacent said ring, said ring having internal dimensions to accommodate golf shoe cleats for permitting the inserting of said ring around a cleat to enable cleaning of said cleat.

* * * * *